US007681566B2

(12) United States Patent
Mertens

(10) Patent No.: US 7,681,566 B2
(45) Date of Patent: Mar. 23, 2010

(54) ADJUSTABLE ARROW REST APPARATUS

(76) Inventor: Gregory A. Mertens, 4211 Catalina Dr., Jefferson City, MO (US) 65109

( * ) Notice: Subject to any disclaimer, the term of this patent is extended or adjusted under 35 U.S.C. 154(b) by 246 days.

(21) Appl. No.: 11/620,010

(22) Filed: Jan. 4, 2007

(65) Prior Publication Data

US 2007/0163560 A1 Jul. 19, 2007

Related U.S. Application Data

(60) Provisional application No. 60/756,413, filed on Jan. 4, 2006.

(51) Int. Cl.
*F41B 5/22* (2006.01)

(52) U.S. Cl. ..... 124/44.5

(58) Field of Classification Search ..... 124/44.5
See application file for complete search history.

(56) References Cited

U.S. PATENT DOCUMENTS 5,144,937 A * 9/1992 Colvin ..... 124/44.5
5,394,858 A * 3/1995 Karolian ..... 124/44.5
5,490,491 A * 2/1996 Troncoso ..... 124/44.5
5,722,381 A * 3/1998 Mizek ..... 124/44.5
6,178,959 B1 * 1/2001 Troncoso et al. ..... 124/44.5
6,202,635 B1 * 3/2001 Evans ..... 124/44.5
6,637,419 B1 * 10/2003 Troncoso et al. ..... 124/44.5
6,913,008 B2 * 7/2005 Simo et al. ..... 124/44.5
6,938,616 B2 * 9/2005 Walk ..... 124/86

* cited by examiner

*Primary Examiner*—John Ricci
(74) *Attorney, Agent, or Firm*—Scott R. Zingerman; Fellers, Snider, Blankenship, Bailey & Tippens, P.C.

(57) ABSTRACT

An adjustable arrow rest assembly including a bracket for mounting to an archery bow, a shaft carriage secured to the mounting bracket, a vertical stop extending from the shaft carriage, an elevation block positioned on the shaft carriage which further includes a travel channel for leveling the vertical stop and a launcher capable of rotation in association with the elevation block. The shaft carriage may receive a shaft therein which may support the launcher and/or a launcher body. A bias element may be positioned on the shaft to apply a rotational bias force to the shaft. A travel limiter may be inserted in the travel channel to limit the rotation of the elevation block by limiting the path of travel of the travel channel. The shaft carriage may also be capable of lateral movement within the mounting bracket so as to provide windage adjustment to the arrow rest.

23 Claims, 6 Drawing Sheets

ADJUSTABLE ARROW REST APPARATUS

RELATED APPLICATION

This application claims the benefit of U.S. Provisional Patent Application Ser. No. 60/756,413, filed Jan. 4, 2006.

FIELD OF THE INVENTION

This invention relates generally to the archery industry and more specifically to arrow rests for attachment to archery bows.

BACKGROUND OF THE INVENTION

An arrow rest is a device that is secured to an archery bow. The purpose of the arrow rest is to support the arrow and retain it properly in the window section of the riser of the bow, both before and as it is drawn by the archer. The arrow rest maintains the arrow in this position as held by the archer momentarily as the archer aims and readies to release the bow string. Once the bow string is released by the archer, the arrow rest guides the initial flight of the arrow as it is propelled forward by the releasing bow string.

When the bow string was released, inconsistencies in drawing the string may be transferred to the arrow causing the arrow to flex and bend as the arrow leaves the bow. This inconsistent flight path thereby affects the accuracy of the arrow propelled toward the target and thus the accuracy and consistency of the bow (and archer).

As bow technology has progressed, bows have become capable of releasing an arrow at much greater velocity than was previously known. This increase in arrow velocity compounded the bending and flexing problem described above.

Arrow rests help reduce this problem by absorbing some of the forces that cause the arrow to bend or flex thereby releasing an arrow that has little movement.

An additional problem exists in that that the arrow rest may contact the vanes or fletching of the arrow upon release. Such contact has been known to also affect the flight, and thereby the accuracy of the arrow.

Arrow rests that are under biased resistance are known to deflect downward upon release of the arrow to further improve the flight and accuracy. Certain rests are designed to completely drop away so that the effect of the rest upon the flight of the arrow was further reduced. Certain other of these rests are capable of holding the arrow in place before the arrow is drawn by the archer while still drop away from contact upon release by the archer.

A need, therefore, exists for an arrow rest apparatus capable of supporting an arrow before it is drawn by the archer but yet does not interfere with or contact the vanes, fletching, or other component of the arrow as it is released from the bow by the archer. A further need exists for such an arrow rest apparatus which provides lateral and/or elevational adjustment.

SUMMARY OF THE INVENTION

The adjustable arrow rest apparatus of the present disclosure includes, generally, a mounting bracket, a shaft carriage secured in the mounting bracket, a vertical stop extending from the shaft carriage, an elevation block positioned on the shaft carriage and a launcher positioned on the shaft carriage. The elevation block includes a travel channel therein for receiving the vertical stop. The launcher may be secured to a launcher body and is in rotational cooperation with the elevation block The mounting bracket secures the arrow rest to an archery bow using conventional means. The shaft carriage may be removable and/or capable of lateral movement within the mounting bracket so as to provide windage adjustment to the arrow rest. This is accomplished by securing the shaft carriage within the mounting bracket so that it may be unsecured, repositioned and then secured again. The shaft carriage may also be fixed to the mounting bracket.

The shaft carriage is positioned adjacent to the elevation block such that the vertical stop is positioned within the travel channel. The elevation block rotates in relation to the shaft carriage and is limited by the path of travel of the travel channel since the vertical stop is secured within the shaft carriage. Since the shaft carriage is secured into the mounting bracket, the shaft carriage, and therefore the vertical stop, does not rotate. The elevation block may be positioned on a shaft which extends into the shaft carriage in a first embodiment or may be positioned directly onto, but capable of rotation in relation to, the shaft carriage. The launcher may be secured to the elevation block or secured to a launcher body which may be positioned on the shaft in the first embodiment or on the shaft carriage in the alternate embodiment. The launcher is in rotational coordination with the elevation block. The launcher could be of any configuration known in the art and/or could be of any material such as rubber (elastomer), plastic, or metal.

The elevation of the launcher is determined by the coordination of the travel channel in the elevation block in relation to the vertical stop. Elevational adjustment of the launcher is provided by a limit for varying the path of travel of the travel channel as the elevation block rotates around the vertical stop.

A bias element, such as a spring or other such elastomeric member, may be included so as to provide rotational biasing force to the elevation block. The bias element thereby provides a rotational bias force to the launcher since the launcher is in rotational coordination with the elevation block. The amount of tension on the bias element can be varied so as to vary the rotational bias force applied by the bias element to the elevation block.

The adjustable arrow rest of the present disclosure may be embodied as a drop-away or as a shoot-through arrow rest which are each known in the industry. In relation to the drop-away embodiment, a cord may be connected or secured to an extension on the elevation block on one end and to the bow string or cable on the other such that when the archer draws the bow string, the cord applies a rotational force to the elevation block so as to position the launcher in contact with the arrow. Once the bow string is released by the archer, the rotational force applied to the elevation block by the cord is released and the launcher, being in rotational coordination with the elevation block, drops away from the arrow. The amount of rotation of the elevation block is limited by the path of travel of the travel channel since the vertical stop extends therein and is limited thereby. The bias element applies a rotational bias force so as to rotate the elevation block, and thereby the launcher, away from contact with the arrow.

The adjustable arrow rest of the present disclosure may also be configured in a shoot-through embodiment. The shoot-through embodiment is substantially identical to the drop-away embodiment with the exception that the launcher is positioned so as to be in contact with the arrow in a rest position and then is rotated away from contact with the arrow upon release of the bow string by the archer. However, the extent of rotation of the elevation block is limited by the path of travel of the travel channel with the vertical stop extending therein. In the shoot-through embodiment, the bias element is reversed so as to apply rotational bias to the elevation block, and thereby the launcher so as to rotate the launcher in contact with the arrow in the rest position.

It is therefore an object of the present disclosure to provide an adjustable arrow rest apparatus to support an arrow without interfering with or contacting a fletching or other component of the archery arrow in an effort to prevent undesired deflection and/or misdirection of the arrow.

It is a further object of the present disclosure to provide an adjustable arrow rest apparatus which provides a lateral windage adjustment without affecting the other settings of the arrow rest.

It is another object of the present adjustable arrow rest apparatus to provide an arrow rest mechanism which is capable of an elevational adjustment.

The above and other objects of this invention are accomplished by the adjustable arrow rest apparatus described herein, depicted in the drawings and defined in the accompanying claims. Additional objects of the present adjustable arrow rest apparatus invention will become apparent to those skilled in the art.

DETAILED DESCRIPTION OF THE PREFERRED EMBODIMENTS

Figure 1:
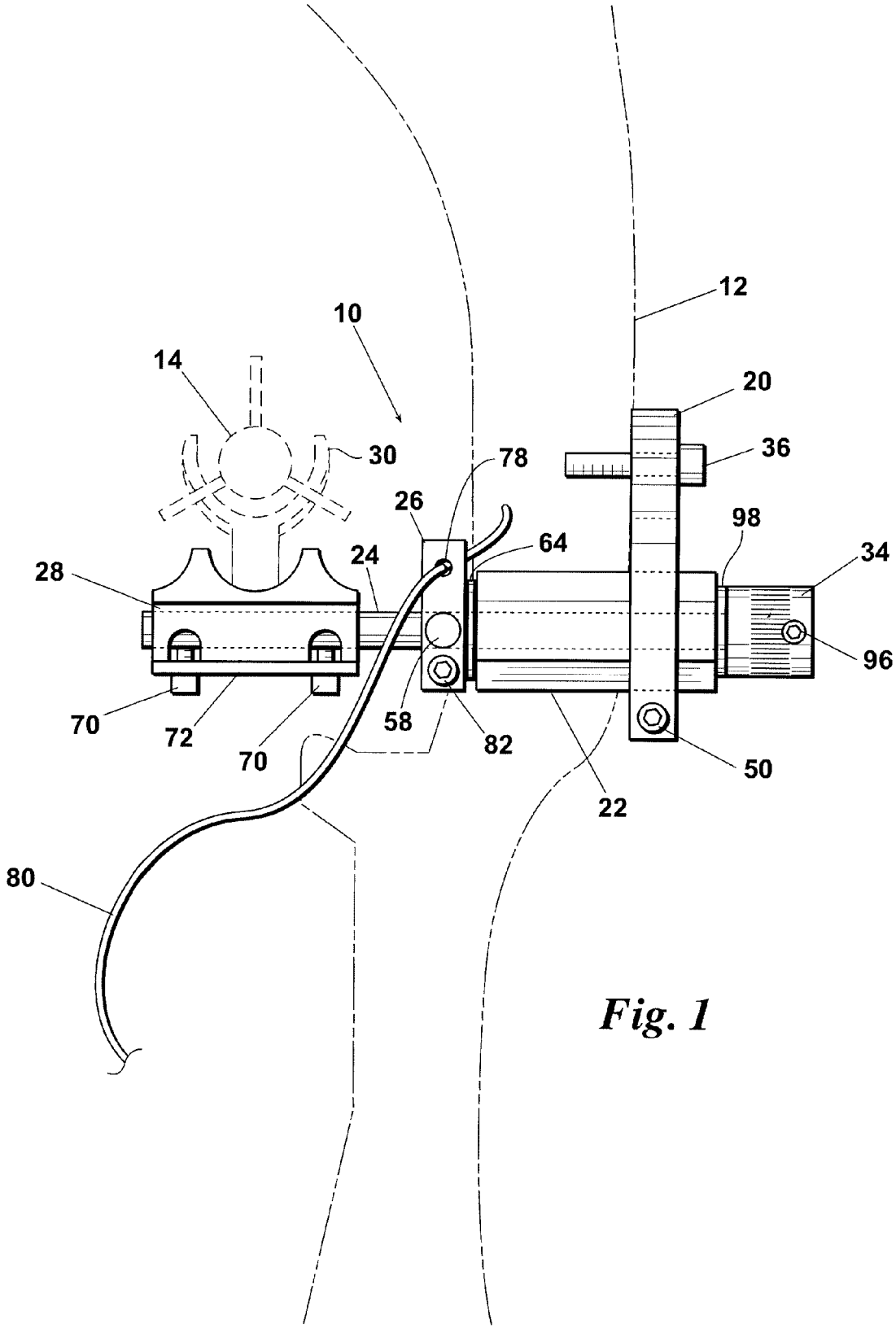
FIG. 1 is a front view of the arrow rest apparatus of the present disclosure configured in a drop-away embodiment and depicted mounted on an archery bow.

Referring now to the drawings, wherein like reference numerals designate corresponding structure throughout the views, and referring in particular to FIG. 1, the arrow rest 10 of the present disclosure is depicted in a drop-away embodiment. As shown, arrow rest 10 is depicted secured to an archery bow 12 partially shown in phantom and positioned in the shooting position as is known in the art. FIG. 1 depicts arrow rest 10 on archery bow 12 supporting an arrow 14 in a view looking down the longitudinal axis of arrow 14 as it would be viewed by the archer.

Figure 2:
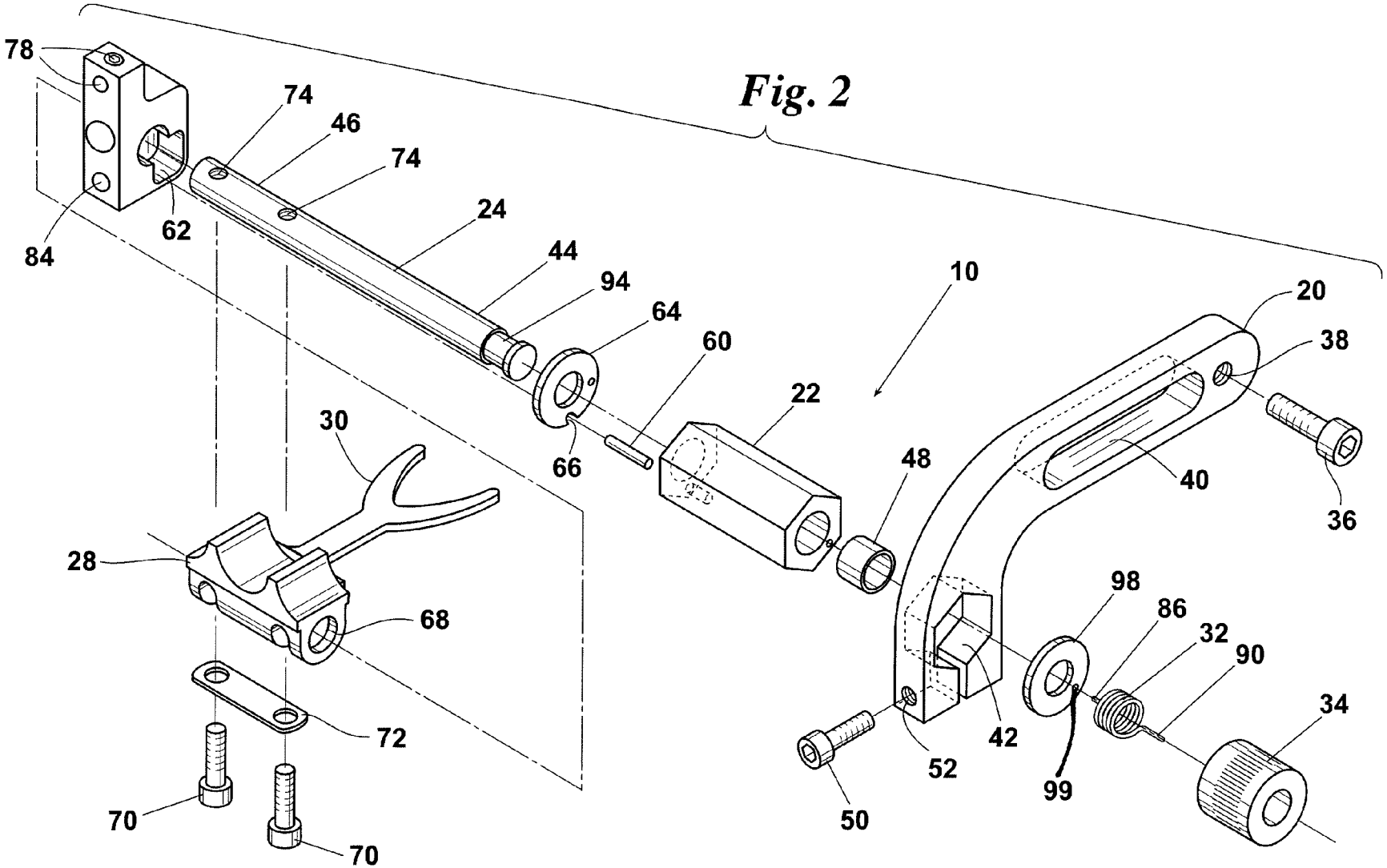
FIG. 2 is an exploded view of one embodiment of the arrow rest of the present disclosure.
Figure 3:
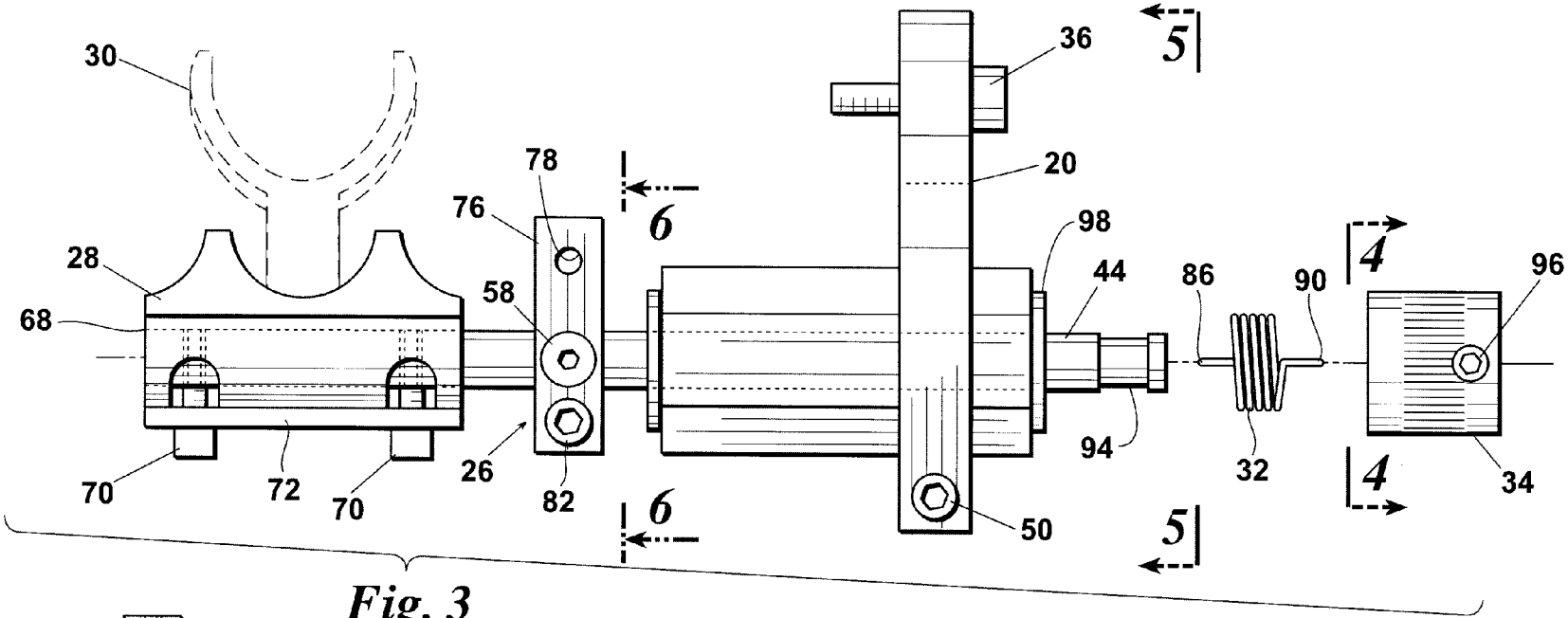
FIG. 3 is a partially exploded front view of the arrow rest of the present disclosure configured in a drop-away embodiment.

With reference to FIGS. 1-3, the adjustable arrow rest apparatus 10 of the present disclosure is depicted in the drop-away embodiment including mounting bracket 20, shaft carriage 22, shaft 24, elevation block 26, launcher 30, bias element 32 and tension knob 34. A launcher body 28 may be positioned on the shaft adjacent elevation block 26 to which launcher 30 is secured.

With reference to FIGS. 1-3 and 5, mounting bracket 20 can be affixed to an archery bow in a known manner, such as depicted in FIG. 1, by inserting a screw, such as mounting screw 36 through threaded hole 38 (FIGS. 2 and 5) or through slot 40 and into bow 12. Slot 40 allows for linear adjustment of arrow rest 10 in relation to bow 12 as desired by tightening mounting screw 36 in a desired position along the length of slot 40. Mounting bracket 20 provides the support for the remaining elements of arrow rest 10 and for securely attaching arrow rest 10 to bow 12.

Figure 7:
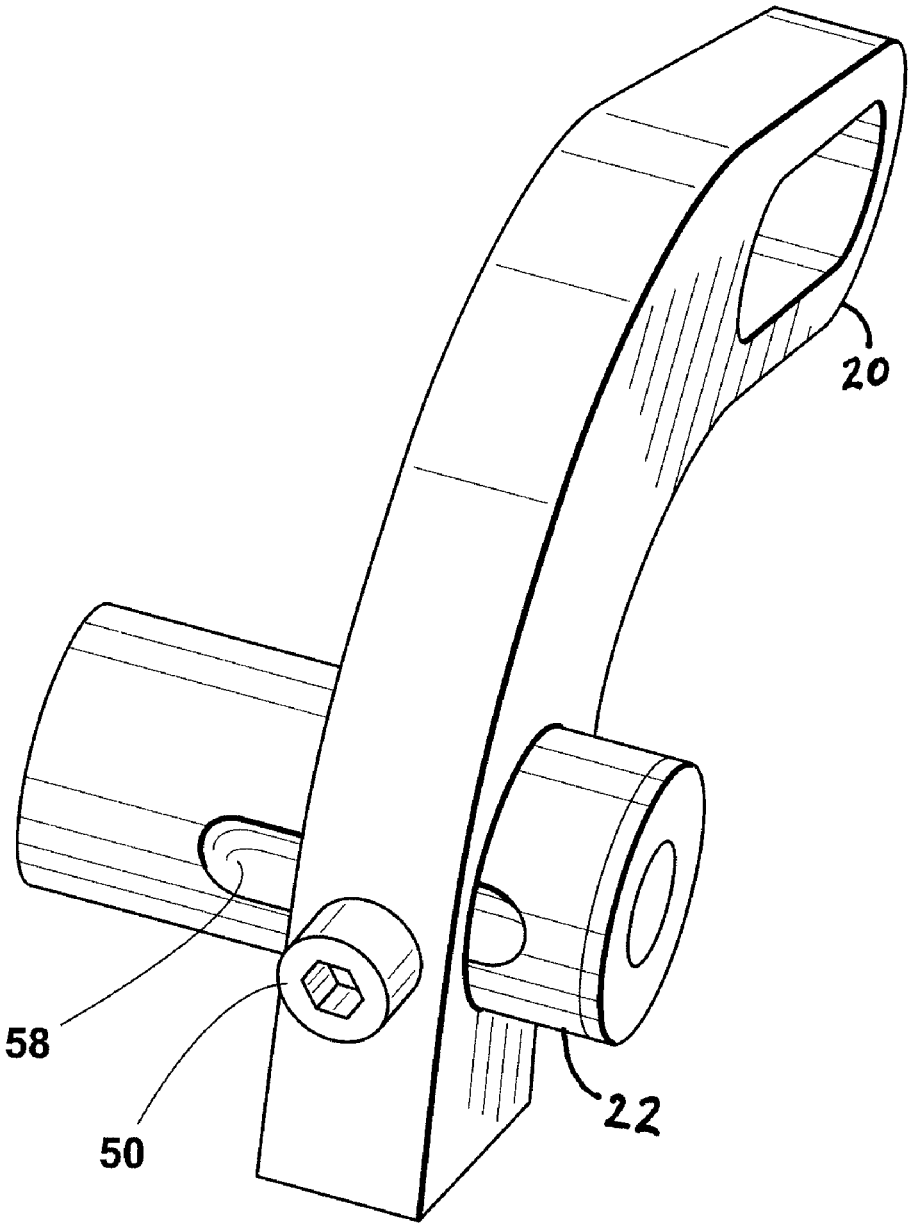
FIG. 7 is an isometric view of an alternate embodiment of the mounting bracket and carriage block of the arrow rest of the present disclosure.

Mounting bracket 20 includes a slotted passage 42 therein to receive and retain shaft carriage 22. In a preferred embodiment, both slotted opening 42 and shaft carriage 22 are configured in a hexagonal geometry which is particularly suitable so as to support the remaining elements of arrow rest 10 from shaft carriage 22 in a secure manner while still allowing lateral windage adjustment to arrow rest 10 without affecting the elevation of launcher 30 or any other adjustments described below. It is understood, however, that shaft carriage 22 may be configured in any suitable embodiment so as to secure shaft carriage 22 within mounting bracket 20 in the described manner. For example, shaft carriage 22 could be configured in alternate geometries from the hexagonal geometry defined in the preferred embodiment such as a square, triangle, octagonal, or other like geometries. In addition, with reference to FIG. 7, shaft carriage 22 could be alternately configured in a circular or oval geometry as will be described in further detail below.

Referring back to FIGS. 1-3 and 5, lateral windage adjustment is provided to arrow rest 10 in a preferred embodiment through the use of a set screw 50 which extends through segments 54 and 56 defined by the slotted portion of slotted shaft 42. Shaft carriage 22 is inserted in slotted opening 42 in mounting bracket 20 and secured in place by set screw 50 being threaded into a threaded hole 52 which is drilled and tapped in mounting bracket 20 through the slotted portion of the slotted opening 42, segments 54 and 56 bounding slotted opening 22 are drawn together thereby tightening (clamping) and securing shaft carriage 22 within slotted opening 42. Lateral windage adjustment is accomplished by retracting set screw 50 from hole 52 thereby relieving the clamping tension between segments 54 and 56 of mounting bracket 20 and allowing shaft carriage 22 to be moved or positioned laterally within mounting bracket 20 to a desired positioned to account for windage and then set screw again tightened within hole 52 so as to again tightly secure shaft carriage 22 within slotted opening 42.

In the alternative, and again with reference to FIG. 7, mounting bracket 20 and shaft carriage 22 could be configured such that a slot 58 is machined into the outer surface of the shaft carriage 22 such that set screw 50 is threaded into mounting bracket 20 and into slot 58. In this embodiment, lateral windage adjustment is provided by retracting set screw 50 from contact within channel 58 such that shaft carriage 22 may be moved laterally within mounting bracket 20 to a desired windage adjustment position. Set screw 50 is again tightened within mounting bracket 20 into frictional engagement within channel 58 of shaft carriage 22 to secure shaft carriage 22 at the desired lateral windage adjustment position within mounting bracket 20.

In the preferred embodiment depicted in FIGS. 1-3, shaft 24 extends through into and through shaft carriage 22 and includes a first end 44 and a second end 46 such that first end 44 extends through shaft carriage 22 and second end 46 remains extending out of shaft carriage 22. In the preferred embodiment a bushing 48 is positioned between shaft carriage 22 and shaft 24 so as to provide a bearing surface as shaft 24 rotates within shaft carriage 22.

An elevation block 26 is positioned on second end 46 of shaft 24. Elevation block 26 is securely retained to shaft 24 in a suitable manner such as by screw 58 which is threaded through elevation block 26 into frictional contact with shaft 24. Elevation block 26 is shown in greater detail in FIG. 6. Elevation block 26 includes a travel channel 62 which is machined to extend partially through the width of elevation block 26. Travel channel 62 is configured to receive a vertical stop 60 which is secured into and extends out of shaft carriage 22. As shall be described in greater below, vertical stop 60 acts to limit the rotation of elevation block 26 to the path of travel of travel channel 62 since vertical stop 60 is positioned to extend within travel channel 62.

As stated, elevation block 26 is positioned on second end 46 of shaft 24 adjacent shaft carriage 22 such that vertical stop 60 which extends from shaft carriage 22 is positioned within travel channel 62 of elevation block 26. A slotted washer 64 may be positioned between shaft carriage 22 and elevation block 26 so as to provide a bearing surface against which elevation block 26 may rotate. Slotted washer 64 includes a slot 66 therein which is shaped to receive and allow vertical stop 60 to extend beyond slotted washer 64 and into travel channel 62 of elevation block 26. Slotted washer 64 may be constructed of any suitable material, however, a plastic or self-lubricating polymer material has been found to be particularly suitable.

Figure 6:
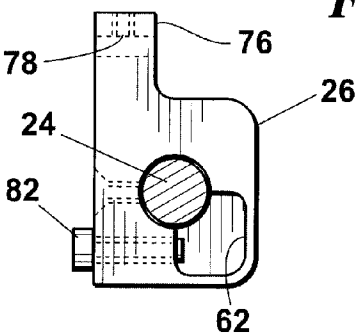
FIG. 6 is a detailed view of the elevation block of the arrow rest of the present disclosure taken along line 6-6 of FIG. 3.

In the drop-away embodiment, elevation block 26 includes a shoulder 76 extending therefrom. As shown in FIG. 6 in phantom, a bore 78 is machined through extension 76. In a preferred embodiment, bore 78 is constructed in a right angle through extension 76 and extending out therefrom. A cord or cable 80 (FIG. 1) is positioned through bore 78 and secured thereto such as by a knot or like restraint. The other end of cord 80 may be affixed to the bow string or cable as known in the art for a drop-away arrow rest. Since elevation block 26 is secured and retained on shaft 24 adjacent second end 46, elevation block 26 is in rotational communication with shaft 24. In this way, elevation block 26 will rotate as shaft 24 rotates but will be limited by the path of travel of travel channel 62 since elevation stop 60 extends therein.

It should be understood, however, that cord 80 could be configured in an alternate embodiment to connect to launcher body 28 or launcher 30. Such alternate embodiments would not affect the operation as described above.

As is conventional with a drop-away arrow rest, when the archer draws the bow string, cable 80 secured thereto will be drawn taught thereby applying a rotational force on elevation block 26 since cord 80 is secured through bore 78. Rotation of elevation block 26 thereby rotates shaft 24 since elevation block 26 is secured to shaft 24 and thereby in rotational coordination with shaft 24. The rotation of elevation block 26, and thereby shaft 24, is limited by the path of travel of travel channel 62 since vertical stop 60 extends therein as shaft carriage 22 into which vertical stop 60 is secured is itself secured within mounting bracket 20 and incapable of rotation therein.

In operation, since elevation block 26 is secured to shaft 24 and rotates therewith, and launcher body 28, and thereby launcher 30 secured thereto, is secured to shaft 24 and rotates therewith. Launcher body 28, and thereby launcher 30, and elevation block 26 rotate together on shaft 24 such that elevation block 26 is in rotational coordination with launcher 30. In operation, when an archer draws the bow string such that cord 80 is drawn taught and applies rotational force to elevation block 26 as described above, elevation block 26, and shaft 24 to which it is secured are rotated. Rotation of shaft 24 thereby rotates launcher body 28 such that launcher 30 is rotated upward so as to support arrow 14 thereon (as depicted in FIG. 1). As the bow string is released by the archer, it moves toward its rest position thereby forcing arrow 14 forward on launcher 30 in the known manner of operation of an archery bow. This release of the bow string releases the tension on cord 80 and thereby the rotational force applied by cord 80 to elevation block 26. The weight of launcher 30 combined with the force applied by arrow 14 causes launcher 30, and thereby launcher body 28, to rotate forward such that launcher 30 drops away from arrow 14 as is known in the art. Rotation of launcher 30, as well as rotation of launcher body 28 to which it is affixed thereby rotates shaft 24 in a direction opposite described above as launcher 30 drops away from contact with arrow 14 as arrow 14 leave bow 12 in its path of travel to a target. Rotation of shaft 24 in turn rotates elevation block 26 to the extent allowed by the path of travel channel 62 as elevation block 26 rotates in relation to vertical stop 60 positioned within travel channel 62.

A travel limiter such as a set screw 82 (FIGS. 1, 3, and 6) may be positioned in elevation block 26 so as to limit the path of travel of travel channel 62 in relation to vertical stop 60. The travel limiter 82, since it extends into travel channel 62, acts to decrease the extent or distance of the path of travel within travel channel 62 such that elevation block 26 will rotate on shaft 24 and contact travel limiter 82. Limiting the path of travel channel 62 acts to vary the elevational height of launcher 30 by limiting the path of rotation of elevation block 26 and thereby the amount of rotation of shaft 24 and launcher 30 secured thereto. Varying that path of rotation affects the elevation of launcher 30.

Elevation adjustment of launcher 30 is provided when travel limiter 82 is adjustable in its length in the amount it can extend into travel channel 62 and thereby limit the path of travel of travel channel 62. This accomplished by providing a drilled and tapped hole 84 in elevation block 26 which extends into travel channel 62 and inserting a set screw, such as set screw 82 which can be threaded into and out of elevation block 26 in order to vary the amount that set screw 82 extends into travel channel 62 thereby varying the path of travel of travel channel 62.

In the preferred embodiment, a bias element 32 may be positioned adjacent first end 44 of shaft 24 so as to apply a rotational bias force to elevation block 26. In the preferred embodiment, bias element 32 is a torsion spring; however, other suitable bias elements are contemplated and known in the art.

Figure 4:
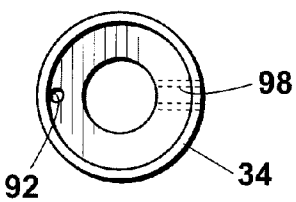
FIG. 4 is a view taken along line 4-4 of FIG. 3 and depicting the tension knob of the present disclosure.
Figure 5:
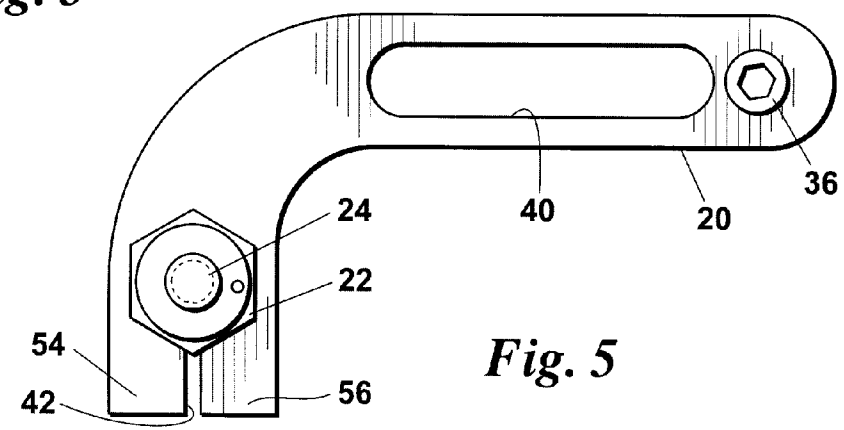
FIG. 5 is a partial side view of the arrow rest embodiment of the present disclosure taken along line 5-5 of FIG. 3.

As depicted in FIGS. 2 and 3, bias element 32 is positioned on first end 44 of shaft 24 such that one end 86 extends into a hole 88 positioned in shaft carriage 22 while a second end 90 of bias element 32 extends into a hole 92 of a tension knob 34 (FIG. 4). First end 44 of shaft 24 includes a recessed portion 94 onto which tension knob 34 is secured by way of a set screw 96. Set screw 96 is threaded through tension knob 34 through a hole 98 drilled and tapped therein and into frictional contact with first end 44 of shaft 24 at recessed portion 94. Recessed portion 94 of first end 44 of shaft 24 acts to retain set screw 96 therein and prevent set screw 96, and thereby tension knob 34, from sliding off first end 44 of shaft 24. A washer 98 may be positioned between tension knob 34 and mounting bracket 20 when tension knob 34 is installed adjacent first end 44 of shaft 24. Washer 98 provides a bearing surface against which tension knob 34 rotates and may be manufactured of any suitable material such as plastic or a self-lubricating polymer. Washer 98 includes a hole 99 drilled therethrough to allow the passage of end 86 of bias element 32 to pass therethrough and into hole 88 of shaft carriage 22.

Since tension knob 34 is secured onto first end 44 of shaft 24, tension knob 34 rotates in association with shaft 24 and is in rotational coordination therewith. Since bias element 32 is inserted into shaft carriage 22 on end 86 and into tension knob 34 on end 90, rotation of tension knob 34 in coordination of shaft 24 will apply tension to bias element 32 since shaft carriage 22 is fixed within mounting bracket 20. The amount of tension can be varied by rotation of tension knob 34 in relation to shaft 24. When the desired torsion is achieved, tension knob 34 is secured to shaft 24 by set screw 96 as described above.

In the resting state, bias element 32 applies rotational bias to tension knob 34 and thereby shaft 24. Varying the amount of tension on bias element 32 will vary the amount of rotational force that bias element 32 applies to shaft 24. Since elevation block 26 and launcher body 28 (and thereby launcher 30) are in rotational coordination with shaft 24, applying a rotation force to rotate shaft 24 will, however, rotate elevation block 26 and launcher 30. The rotational force applied by bias element 32 to shaft 24 is adjusted to affect the rate of rotation and rotational acceleration of shaft 24. In the resting position, in the drop-away embodiment, bias element 32 applies rotational bias to shaft 24, elevation block 26, and launcher 30, so as to bias launcher 30 away from contact with arrow 14 (FIG. 1) as limited by the path of travel of travel channel 62 rotating around vertical stop 60. However, when the archer draws the bow string as described above thereby applying a rotational force on elevation block 26 through cord 80, the biasing force applied by bias element 32 is overcome such that bias element 32 is tensioned. Upon release of the bow string by the archer, again as described above, the bias force of bias element 32 acts to again rotate shaft 24, elevation block 26, and launcher 30 away from contact with arrow 14 and is limited by the path of travel of travel channel 62 rotating around vertical stop 60 positioned within travel channel 62.

In the preferred embodiment, a launcher body 28 is positioned on second end 46 of shaft 24 adjacent elevation block 26. A launcher 30 is secured to and supported by launcher body 28. Launcher body 28 is secured to and supported by shaft 24 on second end 46 as is known in the art. For example, in the drop-away embodiment depicted in FIGS. 1-3, launcher body 28 includes a central cavity 68 such that launcher body 28 is positioned onto shaft 24 on its second end 46. Launcher body 28 is retained and secured to shaft 24 by way of screws, collectively 70, which extend through a launcher frame 72, through launcher body 68 and threaded into holes, collectively 74, drilled and tapped in second end 46 of shaft 24. Launcher body 28 is secured to shaft 24 on second end 46 such that launcher body 28, and thereby launcher 30, are in rotational cooperation with shaft 24 such that launcher body 28, and thereby launcher 30, rotate as shaft 24 is rotated.

Figure 9:
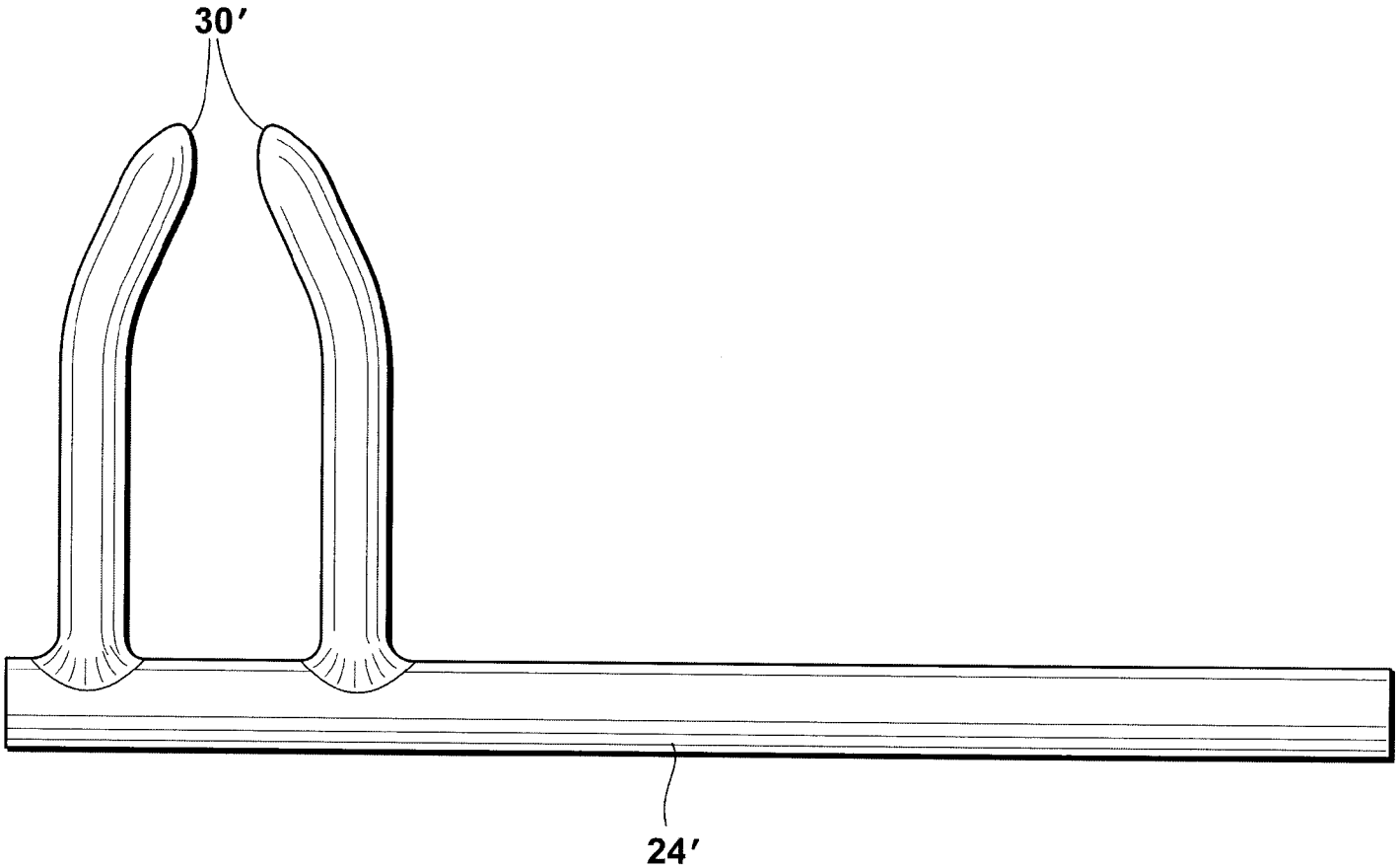
FIG. 9 depicts an alternate embodiment of the shaft and launcher of the arrow rest of the present disclosure.

It should be understood that launcher 30 could be configured so as to be secured directly to shaft 24, thereby eliminating launcher body 28. Such an embodiment is depicted in FIG. 9 wherein launcher prongs 30' are secured directly to shaft 24'. Since launcher prongs 30' are secured directly to shaft 24', rotation of shaft 24' will likewise rotate launcher prongs 30' such that launcher prongs 30' are in rotational coordination with shaft 24'.

Launcher 30 is configured in a known manner to receive an arrow, such as arrow 14 of FIG. 1, when shaft 24 is rotated, thereby rotating launcher body 28 and launcher 30 secured thereto.

Figure 8:
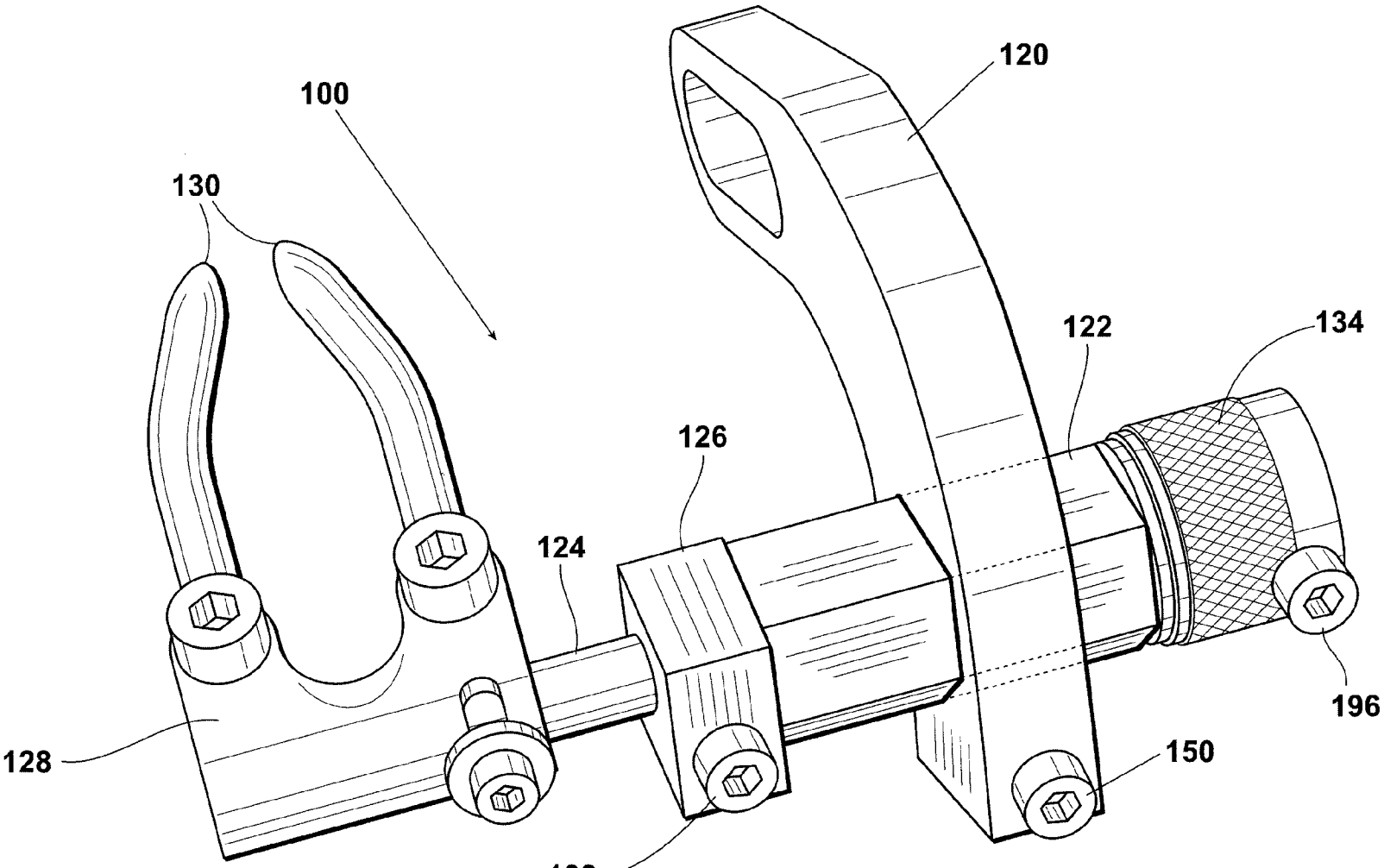
FIG. 8 depicts the arrow rest of the present disclosure configured in a shoot-through embodiment.

FIG. 8 depicts the arrow rest of the present disclosure 100 embodied as a shoot-through arrow rest. The shoot-through arrow rest embodiment of the present disclosure is substantially the same as described above with respect to the drop-away and includes a mounting bracket 120, shaft carriage 122, shaft 124, elevation block 126, launcher body 128, and launcher prongs, collectively 130. Shoot-through arrow rest 100 also includes a bias element secured on shaft 124 within tension knob 134 which is secured to shaft 124 by screw 196 in the same manner as described above with regard to shoot-through arrow rest embodiment 10.

Shoot-through arrow rests are known in the art and differ from drop-away arrow rests in that the arrow (such as arrow 14 of FIG. 1) rests upon launcher prongs 130 in the resting position such that when the bow string is drawn and released by the archer, the forward force of the arrow allows launcher prongs 130, and thereby launcher body 128, to maintain the steady flight of the arrow through the launcher supporting the arrow. As a result, the rotation of shaft 124, and thereby launcher prongs 130, is not dependent upon the draw of the bow string as is the case described above in relation to a drop-away arrow rest. As a result, the only differences in the design of the shoot-through arrow rest embodiment from that described above with regard to a drop-away is that it is not necessary to provide an extension or a cord onto elevation block 126. In addition, since the launcher 130 is biased so as to support the arrow in a resting position as opposed to being biased away as described above with regard to the drop-away embodiment, the biasing element on shaft 124 must be configured in reverse (as in the case of a spring), or so as to provide the requisite bias to maintain launcher prongs 130 in contact with an arrow.

Thus, the present disclosure is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. An arrow rest, comprising:

a mounting bracket;

a shaft carriage secured in said mounting bracket;

a vertical stop extending from said shaft carriage;

an elevation block positioned on said shaft carriage;

said elevation block including a travel channel for receiving said vertical stop;

a travel limiter inserted in said elevation block and into said travel channel to limit the rotation of said elevation block by limiting the path of travel of said travel channel in relation to said vertical stop; and a launcher acting in rotational cooperation with said elevation block.

2. The arrow rest of claim 1 wherein said shaft carriage is capable of windage adjustment.

3. The arrow rest of claim 1 wherein said elevation block is capable of rotation on said shaft carriage.

4. The arrow rest of claim 3 wherein a launcher body positioned on said shaft carriage supports said launcher.

5. The arrow rest of claim 3 wherein said launcher is supported by said elevation block.

6. The arrow rest of claim 1 wherein said vertical stop is secured into and extends from said shaft carriage.

7. The arrow rest of claim 1 wherein said elevation block is capable of rotation in relation to said shaft carriage within the path of travel of said travel channel in relation to said vertical stop.

8. The arrow rest of claim 7 wherein a bias element applies a rotational bias force to said elevation block.

9. The arrow rest of claim 8 wherein said bias element applies a rotational bias force to said elevation block which is limited by the path of travel of said travel channel in relation to said vertical stop.

10. The arrow rest of claim 7 wherein a shaft is positioned within said shaft carriage.

11. The arrow rest of claim 7 wherein a bias element applies a rotational bias force to said shaft.

12. The arrow rest of claim 11 wherein said bias element applies a rotational bias force to said elevational block which is limited by the path of travel of said travel channel in relation to said vertical stop.

13. The arrow rest of claim 12 wherein said bias element is a spring.

14. The arrow rest of claim 12 wherein a tension knob is secured to a said shaft in cooperation with said bias element.

15. The arrow rest of claim 14 wherein said tension knob is capable of adjustment on said shaft in order to vary the rotational bias force said bias element applies to said shaft.

16. The arrow rest of claim 1 wherein said travel limiter is adjustable within said travel channel in said elevation block.

17. An arrow rest, comprising:

a mounting bracket;

a shaft;

a shaft carriage secured in said mounting bracket for receiving said shaft wherein said shaft carriage cannot rotate with respect to said mounting bracket;

a vertical stop extending from said shaft carriage;

an elevation block positioned on said shaft;

said elevation block including a travel channel for receiving said vertical stop;

a launcher positioned on said shaft.

18. The arrow rest of claim 17 wherein a launcher body positioned on said shaft supports said launcher.

19. An arrow rest, comprising:

a mounting bracket;

a shaft having a first end and a second end;

a shaft carriage secured in said mounting bracket for receiving said shaft;

a vertical stop extending from said shaft carriage;

an elevation block positioned on said shaft;

said elevation block including a travel channel for receiving said vertical stop;

said shaft being capable of rotation within the path of travel of said vertical stop within said travel channel;

a travel limiter inserted in said elevation block and into said travel channel so as to limit the rotation of said elevation block by limiting the path of travel of said travel channel in relation to said vertical stop;

a tension knob secured to a first end of said shaft adjacent said first end;

a bias element positioned on said shaft between said shaft carriage and said tension knob to apply a rotational bias force to said shaft such that said elevation block is biased against said vertical stop within said travel channel;

a launcher body positioned on said shaft;

a launcher supported by said launcher body.

20. The arrow rest of claim 19 wherein said shaft carriage is capable of windage adjustment.

21. The arrow rest of claim 19 wherein said bias element is a spring.

22. The arrow rest of claim 19 wherein said tension knob is capable of adjustment on said shaft in order to vary the rotational bias force said bias element applies to said shaft.

23. The arrow rest of claim 19 wherein said travel limiter is adjustable within said travel channel in said elevation block.

* * * * *